United States Patent [19]

Hooker

[11] 4,218,793

[45] Aug. 26, 1980

[54] MOUNTING ASSEMBLY FOR BUNK BED LADDER OR THE LIKE

[75] Inventor: Richard B. Hooker, Linwood, N.C.

[73] Assignee: Hickory Springs Manufacturing Company, Hickory, N.C.

[21] Appl. No.: 957,880

[22] Filed: Nov. 6, 1978

[51] Int. Cl.[2] ..... A47C 17/40

[52] U.S. Cl. ..... 5/8; 5/282 R; 182/106; 248/73

[58] Field of Search ..... 5/8, 9 R, 282 R; 182/106, 206; 248/73, 220.2, 224.4

[56] References Cited

U.S. PATENT DOCUMENTS

| | | | |
|---|---|---|---|
| 1,055,201 | 3/1913 | Mason | 248/222.2 |
| 3,008,534 | 11/1961 | Van Cannon, Jr. | 182/106 |
| 3,881,676 | 5/1975 | Reinwall | 248/224.4 |

*Primary Examiner*—Casmir A. Nunberg

*Attorney, Agent, or Firm*—Richards, Shefte & Pinckney

[57] ABSTRACT

A mounting assembly for hanging a bunk bed ladder from the upper bunk of a bunk bed wherein the vertical flange of one of the upper bed rails is formed with a pair of slots each having an entry portion disposed above and communicating with a narrower retaining portion. A pair of hanger brackets are attached to the bunk bed ladder each bracket having a mounting leg with a narrow region slightly narrower than the retaining portion of the slots and an outer region wider than the retaining portion but slightly narrower than the entry portion of the slots. The mounting legs of the hanger brackets are arranged for insertion through the entry portions of the slots to position the narrow regions thereof for lowering into the retaining portions of the slots, in which they are retained against lateral movement or inadvertent withdrawal by being positioned on the horizontal flange of the bed rail and under the box spring that is supported on the bed rail horizontal flange.

9 Claims, 6 Drawing Figures

MOUNTING ASSEMBLY FOR BUNK BED LADDER OR THE LIKE

BACKGROUND OF THE INVENTION

Bunks beds have traditionally been designed for and used primarily by small children and, for this reason, some of the foremost concerns of both bedding manufacturers and parents are the safety features incorporated in the bunk beds. As a result of this concern for safety, a ladder providing safe and easy access to the upper bunk has become a standard accessory to most bunk beds. Various means of attaching the ladder to the bunk beds have been employed in the past, but regardless of the particular attachment means employed, the means of attachment must sufficiently secure the ladder to prevent inadvertent movement or disengagement thereof from the upper bunk while allowing removal of the ladder from the upper bunk when desired.

A common means of attaching a bunk bed ladder to the upper bunk is a hook type bracket attached to each of the vertical members of the ladder and which simply hooks over a horizontally extending frame member of the upper bunk. Another bracket attachment, which is also affixed to the vertical ladder members and is designed to snap around a horizontally extending frame member of the upper bunk, has also been employed in the past to secure bunk bed ladders to the upper bunk. However, when either of these mounting brackets is employed, the ladder is easily slidable along the horizontal frame member and may be easily lifted off the frame member inadvertently, therefore being generally unacceptable for use on children's bunk beds.

In contrast, the present invention provides a mounting assembly for bunk bed ladders and the like allowing the ladder to be easily and removably mounted on the upper bunk of a bunk bed or the like in a manner which prevents lateral movement of the ladder and resists inadvertent withdrawal or removal thereof.

SUMMARY OF THE INVENTION

The present invention provides a new and novel mounting assembly for hanging a ladder or the like from the upper bunk of a bunk bed or the like, the bunk bed being of the type having a box spring or other relatively rigid mattress support. A support member affixed to the upper bunk is provided with a slot formed therein, and a hanger bracket is provided, having a hanging leg attached to the ladder or the like and a mounting leg extending from the hanging leg. The mounting leg is insertable through the slot and is shaped for retention in the slot against lateral outward movement thereof when the mounting leg is under the box spring, thereby preventing inadvertent withdrawal of the bracket from the slot to maintain the ladder or the like attached to the support member. Preferably, the mounting leg is of a length sufficient to extend below the lower surface of the box spring upon insertion of the mounting leg through the slot.

According to the preferred embodiment of the invention the slot formed in the support member includes an entry portion and a retaining portion disposed below and communicating with the entry portion, the retaining portion being narrower than the entry portion. The mounting leg includes a narrow region of a width less than the width of the retaining portion and an outer region outwardly of the narrow region having a width greater than the width of the retaining portion but less than the width of the entry portion so that the outer region of the mounting leg may be inserted through the entry portion of the slot to position the narrow region thereof in the entry portion for lowering thereof into the retaining portion of the slot. Thus, the mounting leg is retained in the slot in a manner preventing lateral movement of the bracket in the slot or inadvertent withdrawal thereof from the slot to maintain the ladder or the like attached to the support member. This engagement of the narrow region of the mounting leg in the retaining portion of the slot, when combined with the aforementioned preferred extension of the mounting leg under the box spring, assures retention of the bracket and ladder on the bunk bed with the leg and slot engagement preventing lateral movement and the leg under the box spring preventing vertical movement of the leg out of retaining engagement in the slot.

Other objects and features of the present invention will appear in the following description and the drawings relating thereto.

DESCRIPTION OF THE PREFERRED EMBODIMENT

Referring now to the accompanying drawings, the mounting assembly of the present invention is illustrated and hereinafter described with respect to the preferred embodiment, i.e. for hanging a bunk bed ladder from the upper bunk of a bunk bed. However, it is to be understood that the present invention may be applied, without departing from the substance or scope of the present invention, in any situation in which an object is to be hung from a support member. Therefore the present invention should be viewed as being of broad utility unrestricted to the specific construction and uses herein described.

Figure 1:
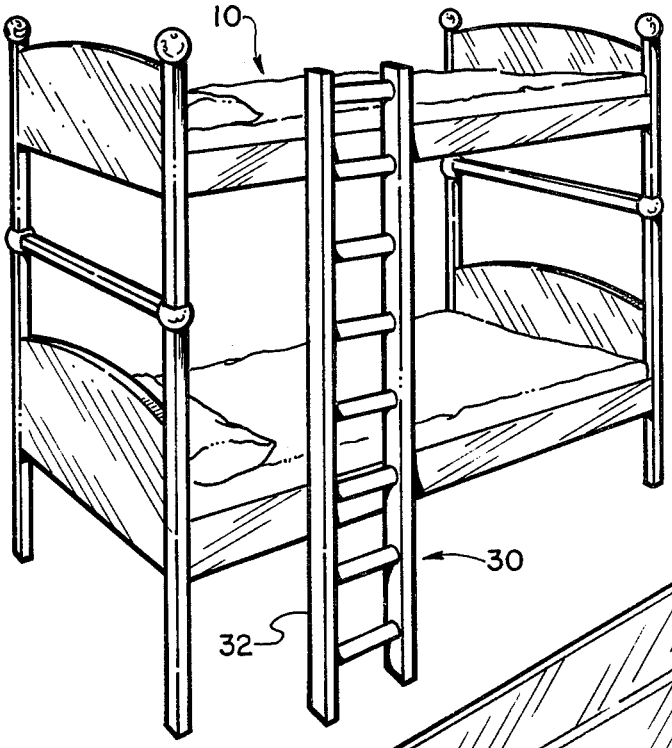
FIG. 1 is a perspective view of a bunk bed with an access ladder attached to the upper bunk thereof.
Figure 2:
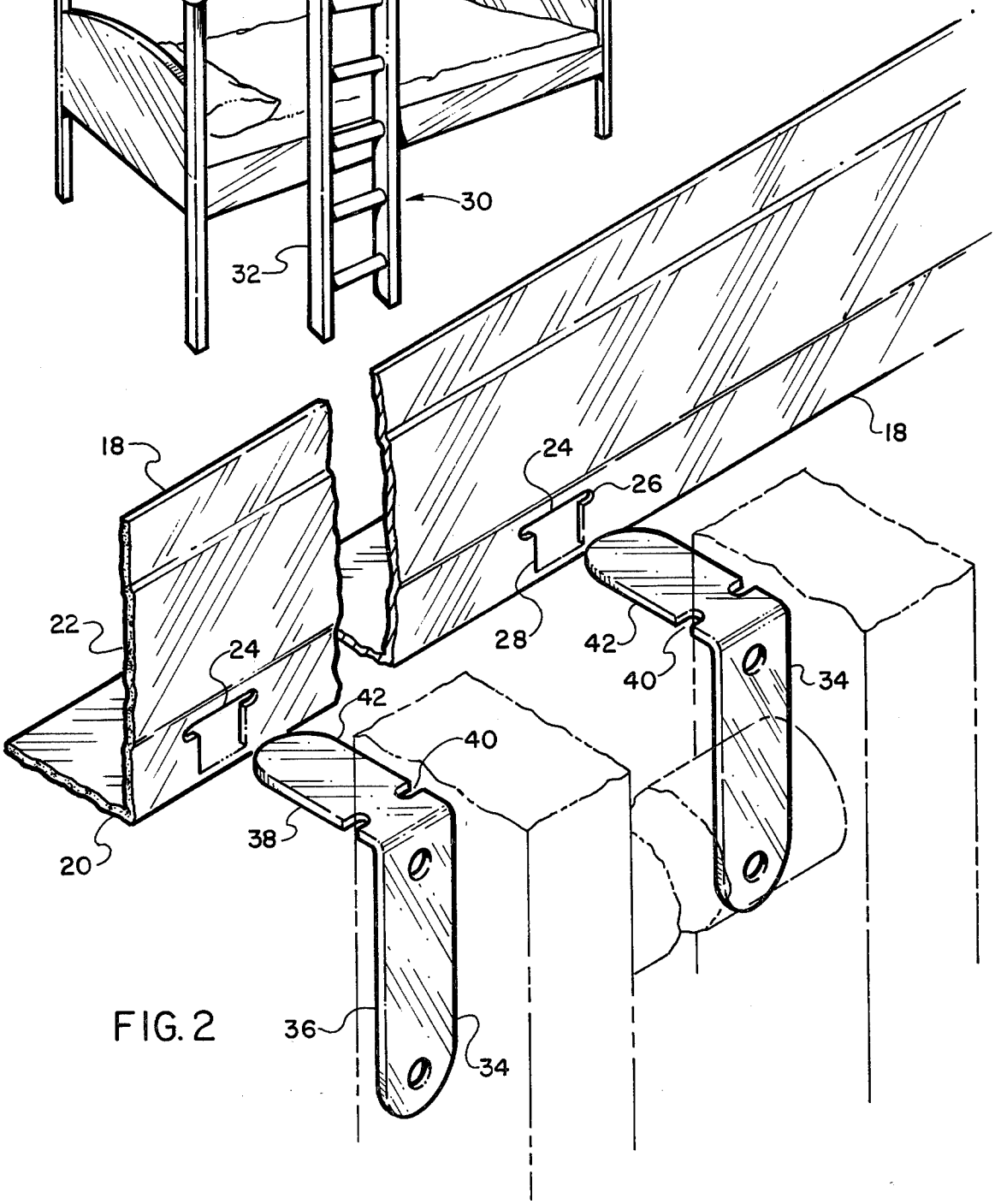
FIG. 2 is an exploded view illustrating the preferred embodiment of the present invention with a pair of hanger brackets in position for insertion into a pair of slots in a support member of the upper bunk.
Figure 4:
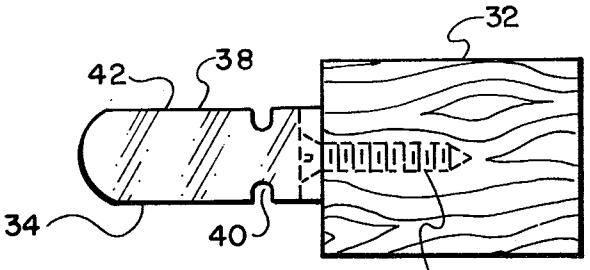
FIG. 4 is a top view of a hanger bracket of FIG. 2 attached to a vertical member of a bunk bed ladder.
Figure 6:
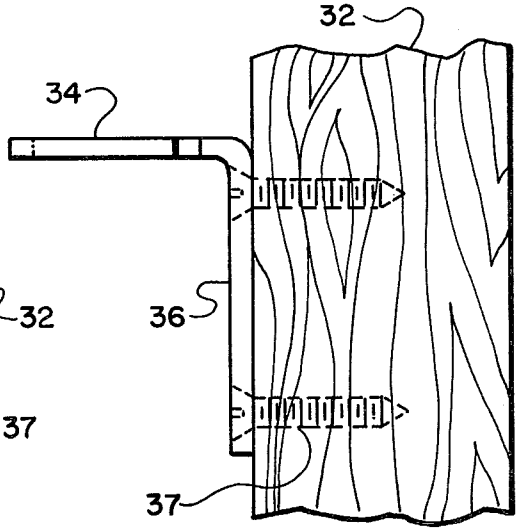
FIG. 6 is a side elevation of the hanger bracket of FIG. 4.
Figure 5:
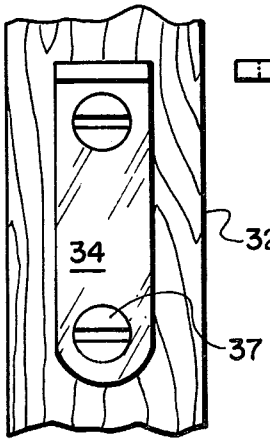
FIG. 5 is a front elevation of the hanger bracket of FIG. 4.
Figure 3:
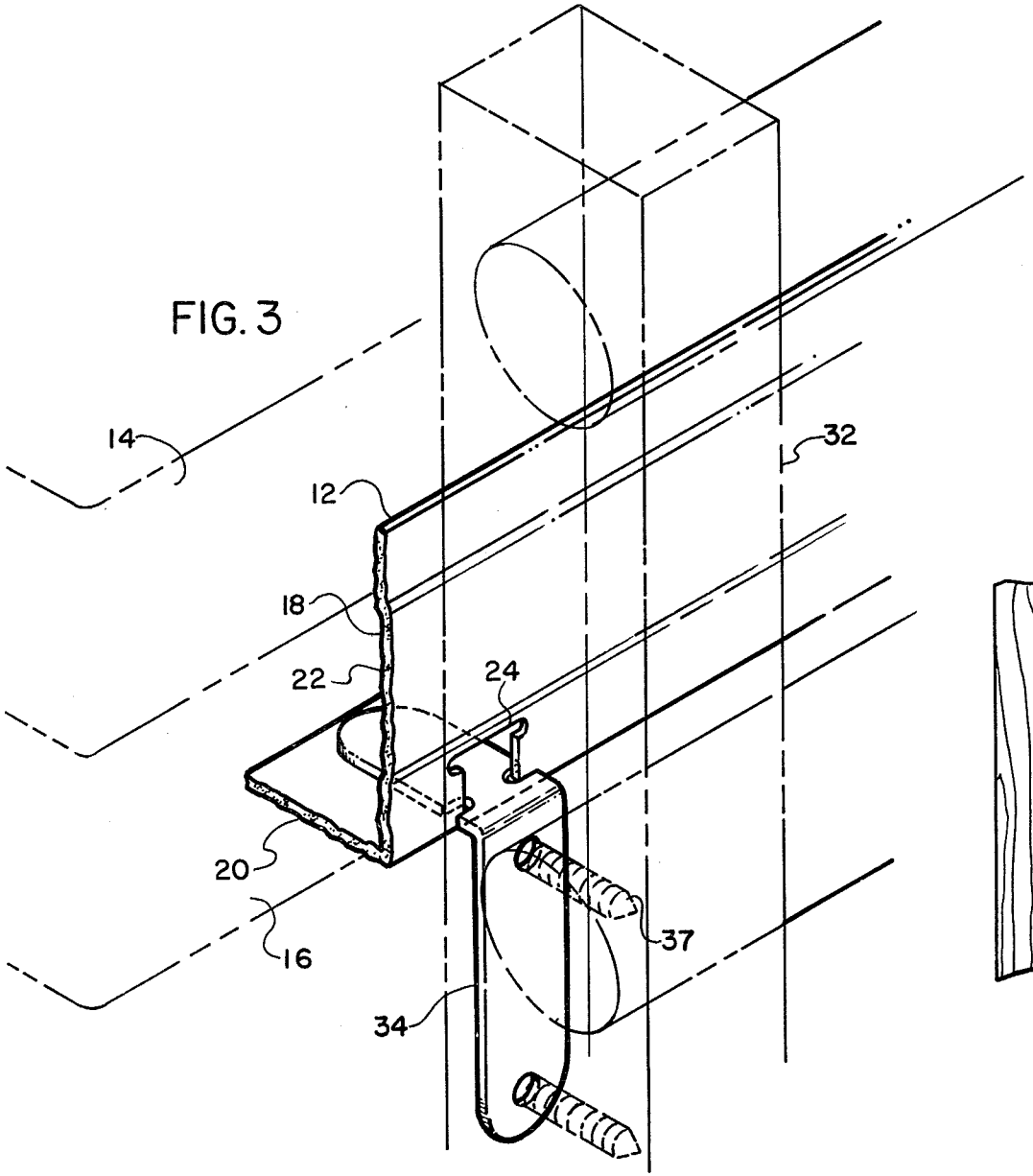
FIG. 3 is a perspective view of a portion of the upper bunk of the bunk bed illustrated in FIG. 1, cut away to show the mounting assembly of FIG. 2.

In FIG. 3, a portion of the upper bunk of a bunk bed is illustrated, being generally indicated at 10, the upper bunk including a bed frame 12 and a mattress 14 and box spring 16. The bed frame 12 comprises a pair of bed rails, only one of which is illustrated and is indicated by the reference numeral 18, which supports the mattress 14 and box spring 16. The bed rail 18 is designed also to serve as a support member for the ladder hanging from the upper bunk and therefore it is provided with a horizontal flange 20 and a vertical flange 22, the box spring 16 normally resting on and being supported by the horizontal flange 20. Horizontal slots 24 are formed in the vertical flange 22 at the juncture of the horizontal and vertical flanges 20 and 22, respectively, adjacent the lower surface of the box spring 16, the slots 24 each having an elongated entry portion 26 and a retaining portion 28 disposed below and communicating with the entry portion 26, the retaining portion 28 being narrower than the entry portion 26.

A ladder, generally indicated at 30, hangs from the upper bunk 10 to provide access thereto, the ladder 30 having attached to each vertical leg 32 thereof a right angled hanger bracket 34. Each hanger bracket 34 is provided with a normally vertically disposed hanging leg 36, rigidly affixed by means of screws 37 to the upper end of the ladder 30, and a normally horizontally disposed mounting leg 38 extending generally perpendicularly from the upper end of the hanging leg 36 for horizontal extension through one of the slots 24. Each mounting leg 38 is formed with a narrow region 40 of a width slightly less than the width of the retaining portions 28 of the slots 24, and an outer region 42 outwardly of the narrow region 40 of a width greater than the width of the retaining portions of the slots 24 but slightly less than the width of the entry portions 26.

Thus, the outer regions 42 of the mounting legs 38 on each leg 32 of the ladder 30 may be inserted through the entry portions 26 of the slots 24 a sufficient distance to position the narrow regions 40 thereof in the entry portions 26 above the retaining portions 28 of the slots 24. The mounting legs 38 may then be lowered to position the narrow regions 40 thereof in the retaining portions 28. Since the slots 24 are formed at the juncture of the vertical flange 22 and the horizontal flange 20, the mounting legs 38, when thus positioned, rest on the horizontal flange 20 of the bed rail 18. Each mounting leg 38 is of a length sufficient to extend below the lower edge of a box spring 16 when positioned in the just described manner.

When the narrow regions 40 of the mounting legs 38 are properly positioned in the retaining portions 28 of the slots 24, the box spring 16 is lowered to rest both on the horizontal flange 20 and on the mounting legs 38 of the hanger bracket 34. In this manner, the slots 24 prevent lateral movement of the hanger brackets 34 and, of course, of the ladder 30, while the weight of the box spring 16 resting on the mounting legs 38 of the hanger brackets 34, serves to maintain the mounting legs 38 in the retaining portions 28 of the slots 24 by resisting any upward movement which might otherwise dislodge the narrow regions 40 of the mounting legs 38 from their resting position in the retaining portions 28 of the slots 24. Thus inadvertent withdrawal of the hanger brackets 34 from the slots 24 and separation of the ladder 30 from the bed rail 18 is prevented.

It can be seen from the above description of the preferred embodiment of the present invention that the utility of the present invention is not limited to the hanging of bunk bed ladders from the upper bunks of bunk beds but may be applied in almost any situation necessitating the hanging of an object from a support member in a secure but easily removable fashion. Additionally it is to be understood that the present invention is not intended to be limited to the particular construction, configuration, shape or size of the support member slot and/or the mounting leg of the hanger bracket, other types of mounting leg/slot assemblies that perform similar functions being equally within the scope of the present invention. Therefore, although the present invention has been described in relation to the preferred embodiments, it is to be understood that modifications and variations may be resorted to without departing from the substance or scope of the present invention as those skilled in the art will readily understand. Such modifications and variations are within the scope of the present invention, which is intended to be limited only be the appended claims and equivalents thereof.

I claim:

1. A mounting assembly for hanging a ladder or the like from the upper bunk of a bunk bed or the like, said bunk bed being of the type having a box spring, said mounting assembly comprising:

(a) a support member affixed to the upper bunk, said support member having a slot formed therein adjacent the box spring, and (b) a hanger bracket having a hanging leg attached to the ladder and a mounting leg extending from said hanging leg, said mounting leg being insertable through said slot, being of a length sufficient to extend below the lower surface of said box spring upon insertion of said mounting leg through said slot, and being shaped for retention in said slot against lateral outward movement thereof when said mounting leg is under said box spring, thereby preventing inadvertent withdrawal of said bracket from said slot to maintain the ladder or the like attached to said support member.

2. A mounting assembly according to claim 1 and characterized further in that said support member is a bed rail, said bed rail including a horizontal flange and a vertical flange, said slot being formed in the vertical flange of said bed rail.

3. A mounting assembly for hanging a ladder or the like from the upper bunk of a bunk bed or the like comprising:

(1) a support member affixed to the upper bunk, said support member having a slot formed therein having an entry portion and a retaining portion disposed below and communicating with said entry portion, said retaining portion being narrower than said entry portion, and (2) a hanger bracket having a hanging leg rigidly attached to the ladder or the like and having a mounting leg extending from said hanging leg, said mounting leg having a narrow region of a width less than the width of said retaining portion of said slot and an outer region outwardly of said narrow region having a width greater than the width of said retaining portion of said slot but less than the width of said entry portion of said slot so that said outer region of said mounting leg may be inserted through said entry portion of said slot to position said narrow region thereof in said entry portion for lowering thereof into said retaining portion of said slot, whereby said mounting leg is retained in said slot in a manner preventing lateral movement of said bracket in said slot or inadvertent withdrawal of said bracket from said slot to maintain the ladder or the like attached to said support member.

4. A mounting assembly according to claim 3 and characterized further in that said upper bunk includes a box spring, said support member slot being disposed adjacent the lower surface of said box spring, and in that said mounting leg is of a length sufficient to extend below the lower surface of said box spring when the narrow region of said mounting leg is in the retaining portion of said slot so that said box spring maintains said mounting leg in said retaining portion of said slot and thereby prevents inadvertent withdrawal of said bracket from said slot and separation of said ladder from said support member.

5. A mounting assembly according to claim 3 and characterized further in that said mounting leg extends generally perpendicularly from said hanging leg for horizontal extension through said slot.

6. A mounting assembly according to claim 3 and characterized further in that said support member is a bed rail.

7. A mounting assembly according to claim 6 and characterized further in that said bed rail includes a horizontal flange and a vertical flange and in that said slot is formed in the vertical flange of said bed rail.

8. A mounting assembly according to claim 7 and characterized further in that said slot is formed at the juncture of the vertical flange with the horizontal flange so that said mounting leg of said bracket is positioned on said horizontal flange when said narrow region is positioned in said entry portion of said slot.

9. A mounting assembly according to claim 8 and characterized further in that said upper bunk includes a box spring which normally rests on the horizontal flange of said bed rail and on said mounting leg of said bracket to prevent withdrawal of said bracket from said slot and separation of said ladder from said bed rail.

* * * * *